United States Patent [19]

Combest

[11] 4,254,525

[45] Mar. 10, 1981

[54] SUBMERGED SURFACE VACUUM CLEANER

[75] Inventor: H. E. Buddy Combest, Huntington Beach, Calif.

[73] Assignee: Aladdin Equipment Company, Huntington Beach, Calif.

[21] Appl. No.: 56,862

[22] Filed: Jul. 12, 1979

[51] Int. Cl.[3] ..... E04H 3/20

[52] U.S. Cl. ..... 15/1.7; 15/401; 15/419

[58] Field of Search ..... 15/1.7, 401, 419

[56] References Cited

U.S. PATENT DOCUMENTS

| | | | |
|---|---|---|---|
| 2,141,811 | 12/1938 | Everson | 15/1.7 |
| 4,100,641 | 7/1978 | Pansini | 15/1.7 |

*Primary Examiner*—Edward L. Roberts

*Attorney, Agent, or Firm*—Lyon & Lyon

[57] ABSTRACT

A vacuum apparatus for the cleansing of submerged surfaces is provided whereby brush devices are centrally located on opposite sides of a suction element and work with a rib to create a vortex thereby facilitating the cleansing action. The suction element consists of multiple chambers, which are separated by a diaphragm integrally connected to oppositely opening access wings. Variable mounting of wing control arms provide for selective cleaning of large or small debris.

10 Claims, 4 Drawing Figures

SUBMERGED SURFACE VACUUM CLEANER

BACKGROUND OF THE INVENTION

This invention relates to vacuum cleaners, and more particularly to those whose primary function is the cleansing of submerged surfaces. The term "submerged surfaces" in the present specification is utilized to denote either the side walls, or the floor of a tank structure containing a liquid.

A tank, such as a swimming pool, has a tendency to accumulate debri when exposed to outside conditions. This debri may be found in various forms. For example, the debri may consist of leaves and other organic matter that often settle to the bottom of a pool thereby creating both an unsanitary and unsightly condition. Debri may also consist of small pebbles and other hardened matter which similarly settles to the bottom of a pool, or tank structure. Even smaller particulate matter, such as common dirt, when mixed with oil, create a film upon these submerged surfaces. This film is not readily removable with a mere suction device, but often necessitates the use of a scrubbing element in conjunction with a suction element.

Because of the inability to reach certain areas in the pool structure, it is desirable to have a device which accomplishes the same cleaning action in either a forward or rearward direction of movement.

As a result of the various size debri and matter found on the surfaces discussed above, it is similarly desirable to have a vacuum cleaner that has the ability to remove the larger matter prior to the scrubbing of the wall, and then to remove the attached film. By removing the larger particles first, it is possible to achieve greater cleaning efficiency.

Various attempts have been made to accomplish the desired cleaning efficiency necessary to economically maintain the required sanitary level in a swimming pool. Prior devices illustrate either a suction device or a brush-and-suction device, however, as the above discussion illustrates, the cleaning of underwater surfaces consists of being able to perform a multitude of functions almost simultaneously.

Prior devices also do not illustrate the ability to cleanse efficiently in either direction of movement. A greater number of moving parts have been required to achieve this desirable result.

Additionally, prior devices do not utilize the viscosity of the fluid, through which they pass, to aid in the scrubbing action required to cleanse the submerged walls of the film that becomes attached after a very short period of time. Previously, this has been unsuccessfully accomplished by a mere row of brushes, which do not obtain the required cleansing efficiency. Attempts to solve this problem have manifested themselves in much heavier and cumbersome devices, which nonetheless fail to achieve an acceptable cleaning level.

SUMMARY OF THE INVENTION

The present invention is directed toward a submerged surface cleaning device which overcomes the disadvantages of those discussed previously.

The present invention briefly comprises a vacuum cleaner housing with oppositely positioned wings. These oppositely positioned wings are mutually engaged with a diaphragm found within the lower portion of a suction element. On lateral opposite sides of the suction element are found multiple brush elements which ride upon the surface to be cleaned and work in conjunction with a rib to create a vortex, which accomplishes the superior cleaning ability found within the invention described herein.

Multiple attachment mounts are found on the wings. By being able to change the mount to which the wing control arms are attached, the movement of the center diaphragm is selectively controlled. When a wing control arm is located on the top attachment mount, the diaphragm opens the vacuum chamber on the same side as the direction of movement; thus permitting the removal of larger debri. By placing the wing control arm on the lower attachment mount, the diaphragm opens the vacuum chamber opposite the direction of movement, thus permitting the brushes and vortex to accomplish cleansing of the smaller particulate matter and attached film.

Therefore, it is one object of the present invention to increase the flexibility of submerged cleansing devices by being able to remove larger matter initially and then remove an attached film layer at a secondary stage.

According to the present invention, there is provided an improved suction and brush device, said device facilitates the removal of both the large particulate matter, and provides for the scrubbing necessary to remove the finer embedded material, hereinbefore labeled a film.

Additionally, it is another object of the present invention to accomplish the desired cleaning action in either a forward or rearward direction of movement. The use of a diaphragm integrally connected to oppositely positioned and mutually engaged wings accomplishes the desired cleaning in either direction of movement. By sectioning off the vacuum element into various compartments, the surface area through which the debri must pass is smaller than in a non-diaphragmed suction element. By decreasing the surface area of the tube, the suction is increased, thereby accomplishing a superior vacuum capability.

It is another object of the present invention to provide centrally located brush elements that remove a deposited film found upon the sumberged surface. These brush elements work in conjunction with a rib structure to create a vortex within the lower portion of the vacuum cleaner, thereby increasing the scrubbing capability of the vacuum cleaner.

It is still another object of the present invention to provide a device which is lightweight and has relatively few moving parts within the housing, yet is able to accomplish increased cleaning efficiency in either direction of movement.

Other objects and advantages of the present invention will be made readily apparent from the following detailed description and the accompanying drawings, wherein:

DESCRIPTION OF THE PREFERRED EMBODIMENT

Figure 1:
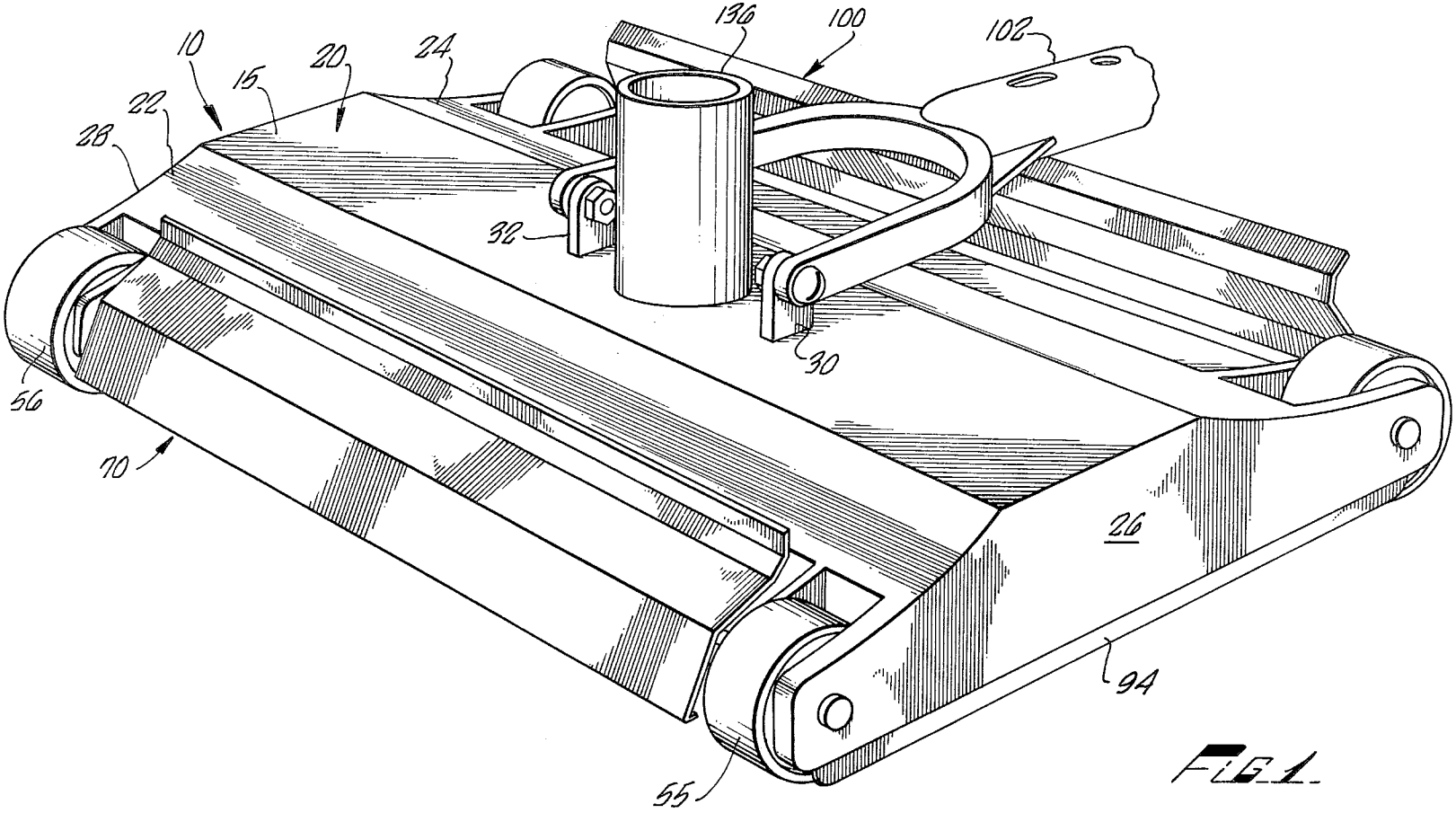
FIG. 1 is an overall perspective view illustrating the top and front elevation of the vacuum cleaner.

Referring now in detail to the drawings, a preferred embodiment of the submerged surface vacuum cleaning system of the present invention, generally designated 10, broadly includes a housing 20 which has a first angular surface 22 and a second angular surface 24 with a first sidewall 26 and second sidewall 28 attached thereto. A right pinion 30 and a left pinion 32 are attached to the upper position of the housing 20 and provide for the attachment of a guide arm.

Figure 2:
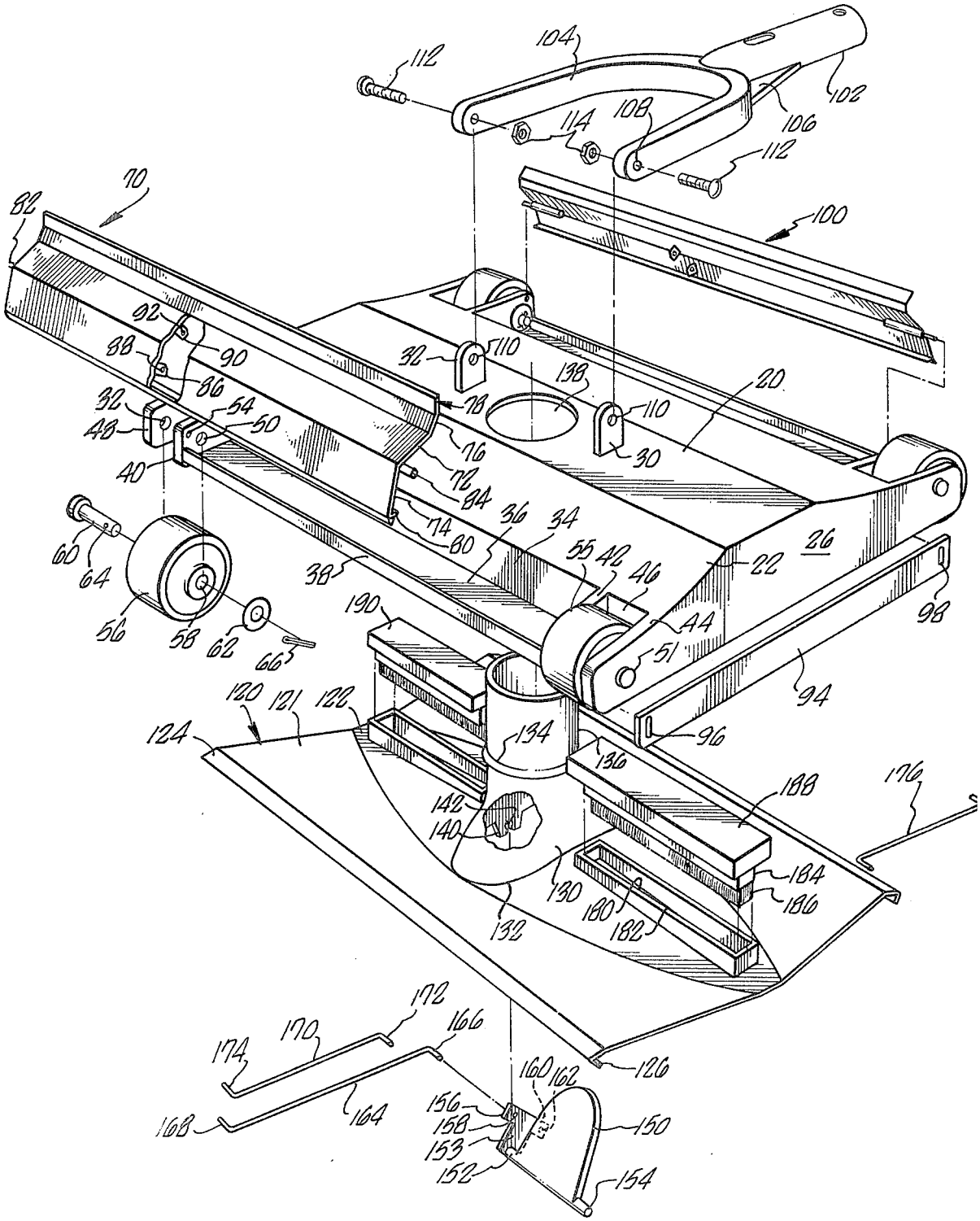
FIG. 2 is an explosion of the vacuum cleaner illustrating the internal components.

As shown in FIG. 2, the first angular surface 22 has a wall 34 attached to it and at right angles with the surface to be cleaned. The wall 34 is attached to a base 36 which is attached to a second wall 38 thereby forming a trough. A lateral wall 40 is attached to the wall 34, base 36, wall 38 and a similar wall 42 is attached to the other end of those walls respectively. A second wall 44 is separated from the wall 42 by a plane 46 thus forming a notch. A similar arrangement is found on the opposite side wherein a wall 48 is separated from the wall 40 by approximately the same distance as between wall 42 and wall 44. Within the wall 40 is a wheel aperture 50 in alignment with an opposing wheel aperture 52 found in the wall 48. Also within the wall 40 is a wing aperture 54.

Supporting the vacuum system 10 is a roller 56 with a bore 58 passing therethrough. The rollers 56 is placed in the notch created by the wall 48 and the wall 40 and the bore 58 is placed in alignment with the apertures 50 and 52. A bolt 60 is passed through this arrangement and a washer 62 is placed upon the protruding end of the bolt 60. A bolt aperture 64 has a pin 66 passed therethrough thus affixing the wheel 56 to the vacuum system 10. Similar wheel configurations are attached at opposite points of the housing 20.

A wing 70 consists of a first plane 72 and a second plane 74 attached at oblique angles. At the opposite end of the plane 72 from the plane 74 is a flange 76 attached to the wall 72. At the uppermost portion of the wing 70 is a flange 78 attached to the wall 76 and bent at an angle thereto. On the bottom portion of the wing 70 is a ledge 80 attached to the wall 74. A pivot bar 82 and a pivot bar 84 are mounted to the wing 70 and provide for its rotation. The pivot bar 82 fits within the aperture 54 and an opposite pivot bar 84 fits within an aperture 55 (not shown) in the wall 42. A mount 86 is attached to the wing 70 and has a mount aperture 88 passing therethrough. A second mount 90 is also attached to the wing 70 and has an aperture 92 passing therethrough.

A skirt 94 has slots 96 and 98 on opposite ends thereof. The skirt 94 fits within the housing 20 on the internal side of the wall 26. The skirt 94 at the slot 96 is in alignment with a wheel aperture 51 which permits the variable control of the skirt height from the submerged surface. A similar arrangement as that of the wing 70 is found upon the opposite wing 100.

A guide arm 102 is attached to a U-Bar 104 and has structural ribs 106 integrally connected therewith. The distal ends of the guide arm 102 have apertures 108 which when aligned with the apertures 110 found in the flanges 32 and 30 provide for the fastening of the guide arm 102 to the top housing 15 by bolts 112. A pair of nuts 114 screw onto the bolts 112 thereby securing the guide arm 102. A platform 120 forms the bottom portion of the housing 20. It has a flat section 122 at its centermost portion. At its distal portions a shoulder 124 is attached to the base 120. At an angle to the shoulder 124 is a rib 126 protruding from the bottom of the housing 20. A similar configuration is found on the opposite side of the platform 120.

Within the base 120 a suction element 130 is attached over a suction aperture 132. The suction element 130 has a ledge 134 which separates it from a suction tube 136. The suction tube 136 passes through an aperture 138 found within the housing 20. On one side of the suction element 130 is found a pair of arms 140 which define an aperture 142. This provides for the placement of a diaphragm 150 within the suction element 130.

The diaphragm 150 has a left leg 152 and a right leg 154 attached at its lowermost portion. The left leg 152 has a bar 153 secured thereto, the bar 153 having a front T-Bar 156 and an aperture 158 passing therethrough. On the opposite end of the bar 153 is a back T-Bar 160 with an aperture 162 passing therethrough. A first control arm 164 has oppositely bent portions, a diaphragm leg 166 and a wing leg 168. A similar arm 170 is shorter than the arm 164 and also has a diaphragm leg 172 and a wing leg 174.

Within the flat section 122 a brush aperture 180 is defined by a brush housing 182. A brush holder 184 passes through the brush aperture 180 thereby permitting the brushes 186 to ride outside the flat section 122. A top section 188 rests upon the ledge 182 thus securing the brush holder 184. A similar configuration is found within the brush holder 190.

Figure 3:
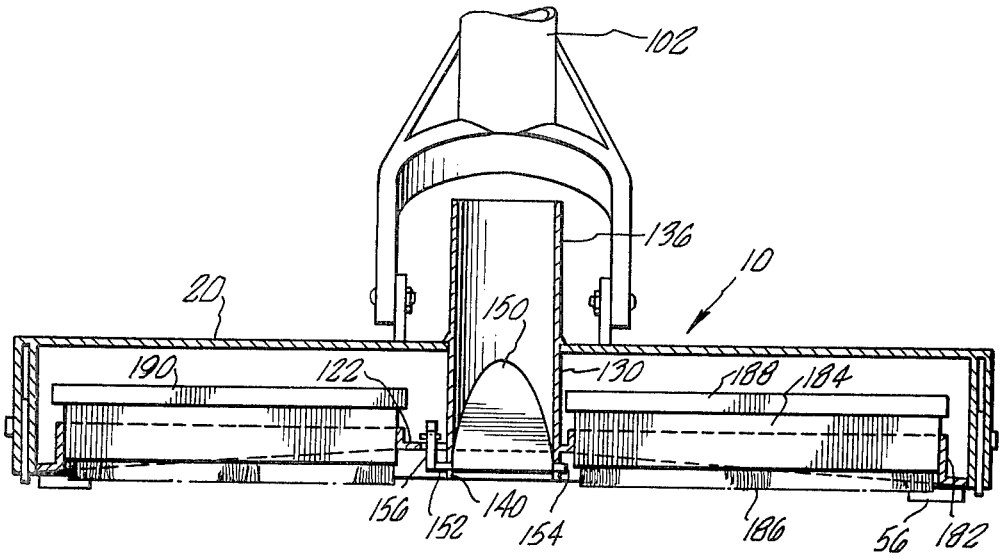
FIG. 3 is a front sectional view illustrating the location of the brush elements in relation to the centrally located diaphragmed vacuum element.

Turning to FIG. 3 a cross section of the vacuum cleaning system 10 is illustrated. In particular, the relationship of the suction element 130 to the brush holders 184 and 190 is illustrated. Also shown is the position of the diaphragm 150 within the suction element 130 and the suction tube 136 shown passing through the top housing 20. The left leg 152 and right leg 154 are shown as is their relationship to the suction element 130 and the T-Bar 156. Also shown is the position of the brushes 186 and 196 in relation to the flat section 122.

Figure 4:
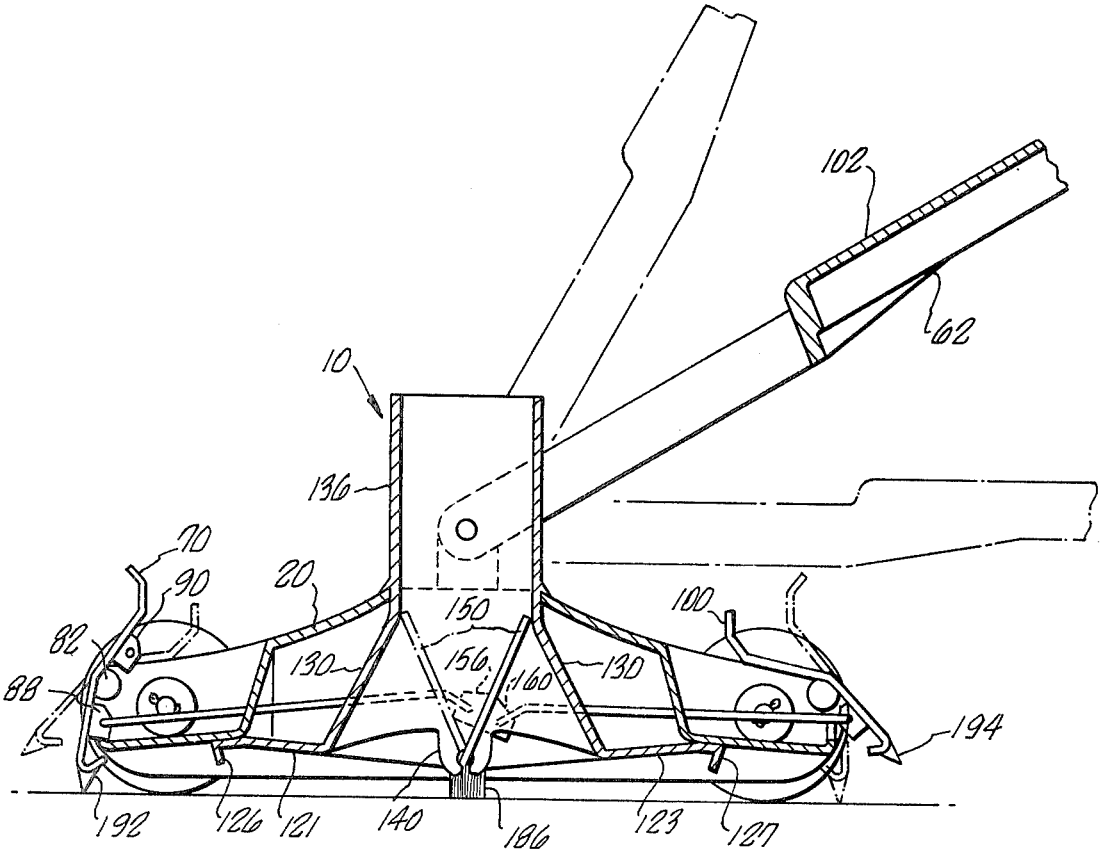
FIG. 4 is a side cross-sectional view illustrating the position of the central diaphragm suction element and the mutually engageable louvered wings.

As shown in FIG. 4, a side cross section of the vacuum cleaning system 10 is illustrated. In particular, the engagement of the diaphragm 150 with the wings 70 and 100 is illustrated. Also shown is the position of the diaphragm 150 within the suction element 130 and its pivot arms 140. The brushes 186 are shown riding upon the submerged surface which is being cleaned. Lastly, a skirt 192 is shown attached to the wing 70 and rests upon the submerged surface. A similar skirt 194 is attached to the wing 100. A control arm 164 is attached to the T-Bar 156 and the wing mount 88 thereby engaging the diaphragm 150 with wing 70. A similar arrangement engages the T-Bar 160 with the wing 100. The shorter control arm 170 will secure the T-Bar 156 with the upper mount 90 thereby providing for selective control of the diaphragm 150 and wing 70 engagement.

When operating the vacuum system 10, the guide arm 102 is rotated away from the direction of movement. Pressure upon a guide arm 102 will cause the vacuum cleaning system 10 to move in the desired direction. Movement of the vacuum system 10 causes a water flow across the top of the housing 15. Said water flow causes the wing 70 to rotate in a clockwise direction about its pivot 82. This rotation by the wing 70 causes the control arm 164 attached to the wing at the mount 88 to pull upon the diaphragm 150 and rotate it in a counter clockwise direction. The bifurcated suction element 130 is then opened in the area opposite the direction of movement. As the brushes 186 ride upon the submerged surface a vortex is created which then passes along the base portion 123 and is restrained by the rib 127. The vortex created aids the brushes 186 in cleansing the submerged surface of a deposited film. Movement of the vacuum cleaning system 10 in an opposite direction reverses the rotation of the wing 70 and the wing 100 now is caused to move in a counter clockwise direction. This movement reverses the direction of the diaphragm 150 and opens the opposite end of the suction element 130 thus permitting cleansing capability in either direction of movement. A similar vortex is formed by the base 121 and rib 126 thus increasing the cleansing capability of the system.

If it is desired to remove larger matter such as leaves and other debris a shorter control arm 170 is attached to the T-Bar 156 and the wing 70. A bent portion 174 of the control arm 170 passes through the aperture 92 in the upper mount 90 of the wing 70. A second bent portion 172 passes through the aperture 58 found in the T-Bar 156 thus engaging the diaphragm 150. Movement of the vacuum cleaner system 10 in a forward direction then causes the wing 70 to rotate in a clockwise direction thus forcing the diaphragm 150 to move similarly in a clockwise direction. This opens up the suction element 130 in its forward section thus permitting the larger particulate matter to pass through the suction tube 136. A similar procedure permits engagement of the wing 100 with the diaphragm 150 via a control arm 176. Thus, it is possible to clean the pool of larger debris and organic matter in either direction.

It should be noted that the wings 70 and 100 are designed such that movement of the vacuum cleaning system 10 over the surface to be cleaned causes a downward force to be exerted upon the system 10. This downward force causes the brushes 186 to ride along the surface to be cleaned in closer proximity thereto.

Having fully described my invention, it is to be understood that I do not wish to be limited to the details set forth, for my invention is the full scope of the appended claims.

I claim:

1. A liquid submerged surface vacuum cleaning system, comprising, a housing, a brush element attached to said housing and adapted to separate said housing into first and second compartments, a means integral with said housing for evacuating said first and second compartments of said housing, a wing movably secured to said housing and adapted to move upon passage of said housing through said liquid, a means within said evacuating means for selectively controlling the evacuation of either said first or second compartment, said controlling means attached to said wing and operable upon movement of said wing from a first to a second position.

2. The apparatus of claim 1, wherein movement of said wing to a first position evacuates said first compartment.

3. The apparatus of claim 1 wherein movement of said wing to a first position evacuates said second compartment.

4. The apparatus of claim 2 or 3 which includes a second wing moveably secured to said housing and operable with said controlling means upon passage of said housing through said liquid wherein said second wing is in a second position when said wing is in a first position and said second wing is in a first position when said wing is in a second position.

5. The apparatus of claim 1 which includes a pair of ridges integral with said housing and spaced apart with said brush element therebetween, said ridges adapted to direct liquid flow within said first and second compartments toward said brush element.

6. An apparatus for the cleansing of surfaces submerged under a liquid, the apparatus comprising, a housing having multiple compartments formed therein, a means for evacuating said compartments, said evacuating means integral with said housing, a means for selecting which compartment is to be evacuated, said selecting means disposed within said evacuating means, a brush element integral with said housing, said brush element adapted to compartmentalize said housing, and said brush element further adapted to travel with said housing in contact with said submerged surface to be cleaned, a wing movably secured to said housing and operable with said selecting means, whereby movement of said wing by passage of said housing through said liquid occasions selected evacuation of said housing compartments by said evacuating means.

7. The apparatus of claim 6, which includes a second wing moveably secured to said housing and operable with said selecting means.

8. The apparatus of claim 6 which includes multiple ridges at least one of which is integral with each compartment within said housing, said ridges adapted to direct flow of fluid within said compartments toward said brush element.

9. An apparatus for the cleansing of surfaces submerged within a liquid, the apparatus comprising, a housing adapted to traverse the surface to be cleansed, a scraping element integral with said housing and adapted to separate said housing into first and second compartments, said scraping element in contact with said surface to be cleansed, a means for evacuating said compartments, said evacuating means integral with said housing, a pair of wings pivotably secured to said housing, each one of said wings pivotably secured on an opposite side of said housing, a diaphragm means operable within said evacuating means for selectively evacuating the compartments of said housing, said diaphragm means operable upon pivotal movement of said pair of wings, a rib means integral with each of said compartments for directing the flow of liquid toward said scraping element, whereby movement of said housing occasions rotation of said wings and movement of said diaphragm means to evacuate only one of said compartments during movement of said housing.

10. The apparatus of claim 9 which includes a means for alternating the compartment being evacuated upon pivoting of said wings.

* * * * *